US009537254B2

(12) United States Patent
Yano

(10) Patent No.: US 9,537,254 B2
(45) Date of Patent: Jan. 3, 2017

(54) CONNECTOR HAVING A FLOATABLE HOLDER WITH A MAGNET

(71) Applicant: HOSIDEN CORPORATION, Yao-shi (JP)

(72) Inventor: Yuushi Yano, Kashiwara (JP)

(73) Assignee: HOSIDEN CORPORATION, Yao-shi (JP)

( * ) Notice: Subject to any disclaimer, the term of this patent is extended or adjusted under 35 U.S.C. 154(b) by 0 days.

(21) Appl. No.: 14/640,347

(22) Filed: Mar. 6, 2015

(65) Prior Publication Data

US 2015/0255919 A1 Sep. 10, 2015

(30) Foreign Application Priority Data

Mar. 10, 2014 (JP) ..... 2014-46824

(51) Int. Cl.

| | |
|---|---|
| ***H01R 13/60*** | (2006.01) |
| ***H01R 13/62*** | (2006.01) |
| ***H01F 7/02*** | (2006.01) |
| ***H01R 12/91*** | (2011.01) |
| ***H01R 13/631*** | (2006.01) |
| *H01R 12/58* | (2011.01) |
| *H01R 13/24* | (2006.01) |

(52) U.S. Cl.

CPC ..... *H01R 13/6205* (2013.01); *H01F 7/0252* (2013.01); *H01R 12/91* (2013.01); *H01R 13/6315* (2013.01); *H01R 12/58* (2013.01); *H01R 13/2421* (2013.01); *H01R 2201/06* (2013.01)

(58) Field of Classification Search

CPC ..... H01R 13/6205

USPC ..... 439/38, 39, 40, 247, 700

See application file for complete search history.

(56) References Cited

U.S. PATENT DOCUMENTS

| | | | | |
|---|---|---|---|---|
| 4,892,491 | A * | 1/1990 | Budano, II | H01R 24/44 439/578 |
| 7,914,348 | B1 * | 3/2011 | Lin | H01R 12/57 439/700 |
| 8,062,078 | B2 * | 11/2011 | Asai | H01R 13/2421 439/482 |
| 8,066,537 | B1 * | 11/2011 | Lin | H01R 11/18 439/824 |
| 8,272,903 | B2 * | 9/2012 | Lin | H01R 13/2421 439/700 |
| 8,568,154 | B2 * | 10/2013 | Chang | H01R 13/6315 439/173 |

(Continued)

FOREIGN PATENT DOCUMENTS

| | | |
|---|---|---|
| EP | 2541367 A2 | 1/2013 |
| GB | 2417143 A | 2/2006 |
| JP | S57-125488 | 1/1981 |

OTHER PUBLICATIONS

Extended European Search Report issued on Aug. 10, 2015 for the counterpart European patent application No. 15158156.8.

*Primary Examiner* — Tulsidas C Patel
*Assistant Examiner* — Peter G Leigh
(74) *Attorney, Agent, or Firm* — Kratz, Quintos & Hanson, LLP

(57) ABSTRACT

A connector including a housing, a magnet, and a holder. The holder is accommodated in the housing in a floatable manner and configured to hold the magnet. The holder includes a mounting wall. The mounting wall is disposed around and in spaced relation to the magnet and bonded to the magnet.

20 Claims, 10 Drawing Sheets

(56) References Cited

U.S. PATENT DOCUMENTS

| | | | | |
|---|---|---|---|---|
| 8,905,795 | B2 * | 12/2014 | Kim | H01R 13/62 439/482 |
| 9,059,523 | B2 * | 6/2015 | Enomoto | H01H 1/54 |
| 9,083,112 | B2 * | 7/2015 | Asai | H01R 13/6205 |
| 9,130,317 | B2 * | 9/2015 | Wang | H01R 13/6683 |
| 9,147,965 | B2 * | 9/2015 | Lee | H01R 13/6205 |
| 9,300,081 | B2 * | 3/2016 | Rudisill | H01R 13/6205 |
| 2008/0280461 | A1 | 11/2008 | DiFonzo et al. | |
| 2011/0104941 | A1 | 5/2011 | Chang et al. | |
| 2012/0262888 | A1 | 10/2012 | Liu | |
| 2013/0065406 | A1 * | 3/2013 | Rohrbach | H01R 13/6205 439/39 |
| 2013/0065407 | A1 * | 3/2013 | Schichl | H01R 13/5841 439/39 |
| 2014/0087569 | A1 * | 3/2014 | Lee | H01R 13/6205 439/39 |

* cited by examiner

CONNECTOR HAVING A FLOATABLE HOLDER WITH A MAGNET

CROSS-REFERENCE TO RELATED APPLICATIONS

The present application claims priority under 35 U.S.C. §119 of Japanese Patent Application No. 2014-46824 filed on Mar. 10, 2014, the disclosure of which is expressly incorporated by reference herein in its entity.

BACKGROUND OF THE INVENTION

Technical Field

The invention relates to a connector and an electronic device having the same.

Background Art

Japanese Utility Model Application Laid-Open No. 57-125488 discloses a conventional connector. This connector includes a housing, a magnet, and a pair of terminals. The housing holds the magnet and the terminals. The magnet is attractable to a magnetic body of a connection object. The connector can be connected to a connection object by bringing the terminals into contact with terminals of the connection object with the magnet attracted to the magnetic body.

SUMMARY OF THE INVENTION

There is a demand for this kind of connectors meeting the following requirements. First, to strengthen the connection between the connector and the connection object, the magnet of a connector should floatingly move in accordance with orientations of the connector with respect the connection object in a process of connection and then should be attracted to a magnetic body of the connection object. Second, there is a demand for downsizing connectors.

Accordingly, the inventors first considered a design in which a magnet is held on a holder floatably disposed in a housing of a connector so that the holder and the magnet are swingable. However, they found it difficult to downsize a connector with a magnet firmly bonded to a holder.

In view of the above circumstances, the invention provides a connector with improved bonding strength of a magnet and also provides an electronic device having the connector.

A connector of an aspect of the invention includes a housing, a magnet, and a holder. The holder is accommodated in the housing in a floatable manner and configured to hold the magnet. The holder includes a mounting wall. The mounting wall is disposed around and in spaced relation to the magnet and bonded to the magnet.

In the connector of this aspect, the magnet, bonded to the mounting walls of the holder, has an increased bonding area with respect to the holder. Accordingly, it is possible to improve the bonding strength of the magnet to the holder.

The connector may further include a yoke. The yoke may be held by the holder and in contact with the magnet.

In the connector of this aspect, when bonding the magnet to the mounting walls of the holder, the magnet is brought into contact with the yoke held in the holder. It is thus possible to bond the magnet to the holder and mount the magnet onto the yoke at a time.

The yoke may include a contact face in contact with the magnet. The mounting wall may be disposed on the contact face, in spaced relation to the contact face, or around the contact face. The magnet may be bonded to the mounting wall and the contact face. In the connector of this aspect, the magnet, bonded to the mounting walls and the contact face, has an increased bonding area with respect to the holder and the yoke held in the holder. Accordingly, it is possible to further improve the bonding strength of the magnet to the holder.

Alternatively, the holder may include a contact face in contact with the magnet. The mounting wall may be disposed on the contact face, in spaced relation to the contact face, or around the contact face. The magnet may be bonded to the mounting wall and the contact face. In the connector of this aspect, the magnet, bonded to the mounting walls and the contact face, has an increased bonding area with respect to the holder. Accordingly, it is possible to further improve the bonding strength of the magnet to the holder.

Another connector of the invention includes a housing, a magnet, a yoke, and a holder. The yoke may be fixed to the magnet. The holder may be accommodated in the housing in a floatable manner and configured to hold the yoke. The holder may include a mounting wall. The mounting wall may be disposed around and in spaced relation to the yoke and bonded to the yoke.

In the connector of this aspect, the yoke fixed to the magnet is bonded to the mounting walls of the holder, so that the yoke has an increased bonding area with respect to the holder. The magnet, indirectly bonded to the holder via the yoke, has an increased bonding area and accordingly has an improved bonding strength with respect to the holder.

The mounting wall may include an inner face having projections and depressions. In the connector of this aspect, the mounting walls with projections and depressions have a further increased bonding area with respect to the magnet or the yoke. Accordingly, it is possible to further improve the bonding strength of the magnet to the holder.

The holder may further include a plurality of side faces and a plurality of first engaging portions. The side faces may include first and second side faces opposed to each other. The first engaging portions may be disposed in the first and second side faces and spaced from each other in a first direction in each of the first and second side faces. The housing may include a plurality of second engaging portion at positions corresponding to the first engaging portions. The first engaging portions may be engaging projections and the second engaging portions may be engaging holes, or alternatively the second engaging portions may be engaging projections and the first engaging portions may be engaging holes. The engaging projection may engage with the engaging holes such as to be movable in a second direction. The second direction may cross the first direction.

Alternatively, the holder may further include a circumferential surface of circular tuboid shape, in place of the side faces. A plurality of first engaging portions may be disposed, not in the first and second side faces, but in the circumferential surface in spaced relation to each other in a first direction. The first direction may be the circumferential direction of the circumferential surface.

In the connector of these aspects, the housing can hold the holder and the magnet in a floatable manner with a simple structure. This is because the housing can hold the holder simply by engaging the engaging projections with the engaging holes movably in the second direction.

The housing may have an opening to allow the magnet to be partially exposed to the outside of the housing. The opening may be of dimensions that are larger than the outer dimensions of the magnet and smaller than the outer dimensions of the holder. In the connector of this aspect, the magnet is exposed to the outside through the opening of the housing, so that the magnet can be easily attracted to a magnetic body of a connection object. In addition, the opening is smaller than the outer shape of the holder, preventing the holder from falling off of the housing.

The connector of any of the above aspects may further include a cover configured to cover at least a side face of the magnet or at least a peripheral surface of the magnet. In the connector of this aspect, the cover protects the side face or the circumferential surface of the magnet exposed from the opening.

the cover may include a tuboid portion and a flange on the tuboid portion. The tuboid portion may be configured to cover the side face or the peripheral surface of the magnet. The flange may be abuttable on an edge of the opening of the housing from inside of the housing. In the connector of this aspect, the cover can be prevented from falling off through the opening of the housing.

The housing may further include an accommodating recess and a top of the accommodating recess. The accommodating recess may be provided in the housing such as to communicate with the opening. The opening of the housing may be made in the top. The holder and the magnet may be accommodated in the accommodating recess in a floatable manner and such that the magnet is partially exposed from the opening. The connector of any of the above aspects may further include a closing member fixed to the housing so as to close the accommodating recess.

The connector of this aspect is easy to assemble. Specifically, the holder and the magnet can be accommodated in the housing simply by accommodating them in the accommodating recess of the housing such that the magnet is partially exposed from the opening and then attaching the closing member to the housing so as to close the accommodating recess.

The connector may further include a terminal held by the housing.

The housing may further include an accommodating hole. The hole may extend through the housing and accommodate the terminal at least partially. The terminal may include a flange held between the housing and the closing member.

The terminal may further include a barrel having electrical conductivity, a plunger movably accommodated hi the barrel, a biasing part, and an insulator. The biasing part may bias the plunger in a direction in which the plunger projects from the barrel. The insulator may be interposed between the biasing part and the plunger.

The connector of any one of the aspects may further include a circuit board and a shield member. The circuit board may be located on one or the other side of a thickness direction of the closing member. The shield member may be located between the circuit board and the magnet.

The housing may further include a slit configured to accommodate a lead wire partially.

An electronic device of the invention includes the connector of any of the above aspects and a housing accommodating the connector.

DESCRIPTION OF EMBODIMENTS

Figure 1A:
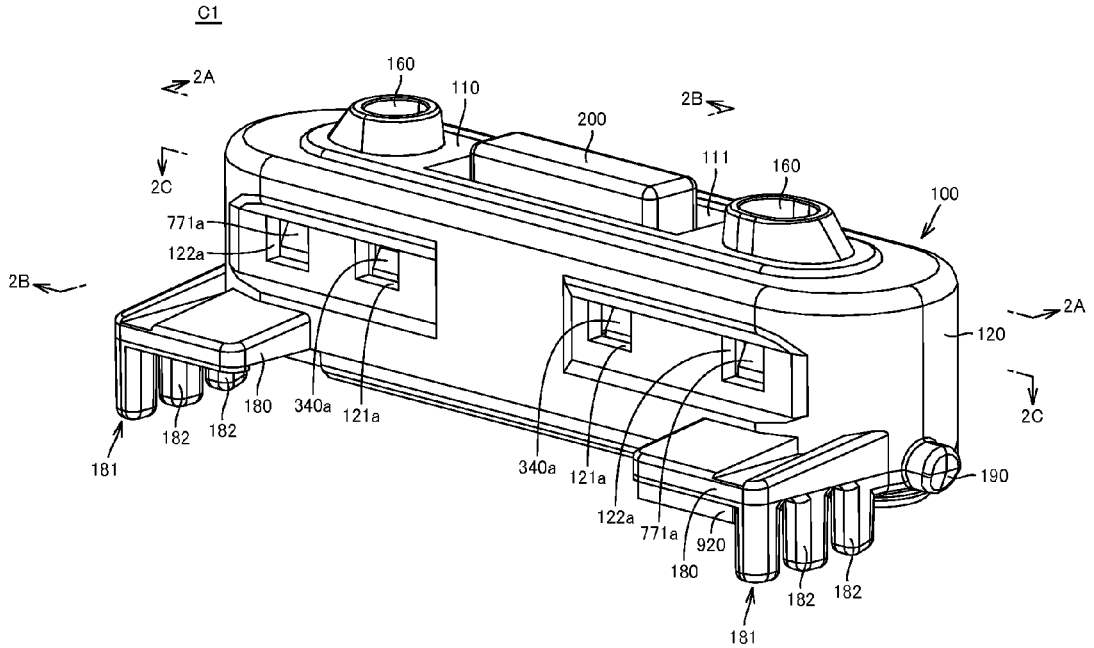
FIG. 1A is a front top right perspective view of a connector according to the first embodiment of the invention.
Figure 1B:
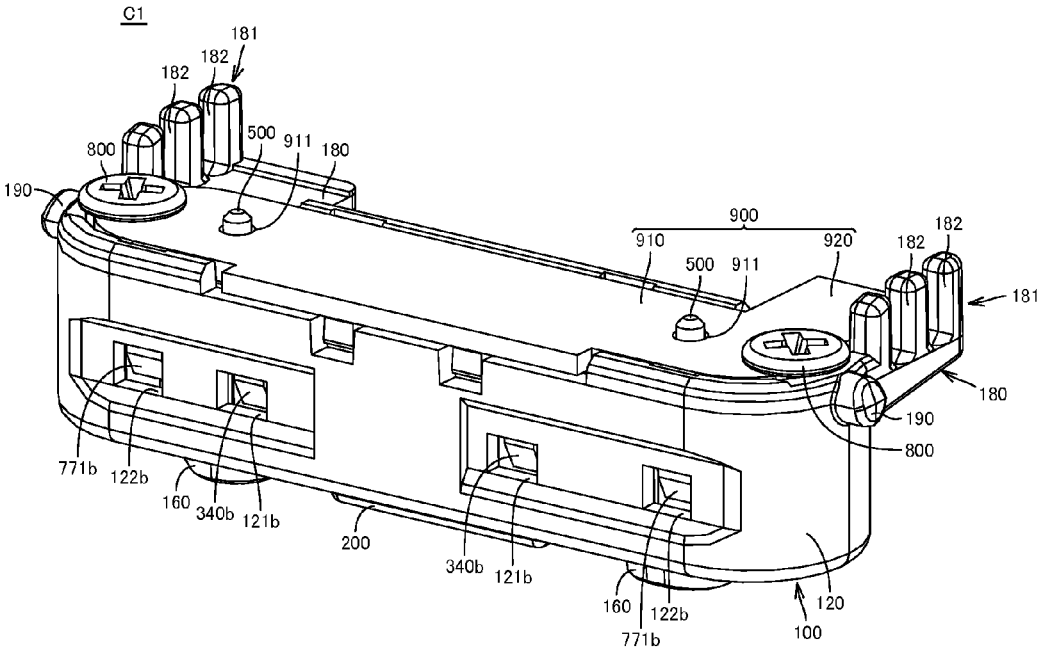
FIG. 1B is a rear bottom right perspective view of the connector.

The first and second embodiments the invention will be described below.

First Embodiment

A connector C1 of the first embodiment of the invention will be described below with reference to FIGS. 1A to 3B. The connector C1 includes a housing 100, a floatable unit, a pair of terminals 500, a shield member 600, a closing member 700, first and second screws 800, and a circuit board 900. These components of the connector C1 will be described below in detail. The Y-Y' direction indicated in FIGS. 2A, 2C, 3A, and 3B is the longitudinal direction of the connector C1 and equivalent to the first direction in the claims. The X-X' direction indicated in FIGS. 2B, 2C, 3A, and 3B is the short direction of the connector C1 and perpendicular to the Y-Y' direction. The Z-Z' direction indicated in FIGS. 2A, 2B, 3A, and 3B is the height direction of the connector C1 and equivalent to the second direction in the claims and to the thickness direction of the closing member 700. The Z direction is equivalent to one side of the thickness direction, and the Z' direction is equivalent to the other side of the thickness direction. The Z-Z' direction is perpendicular to the Y-Y' and X-X' directions.

The floatable unit is floatably held in the housing 100. The floatable unit includes a magnet 200, a holder 300, and a yoke 400. The magnet 200 has a rectangular parallelepiped shape. The yoke 400 is a generally rectangular plate, typically of soft-iron, and serves to increase the pull force of the magnet 200. The yoke 400 is larger in Y-Y' direction dimension than the magnet 200 and also larger in the X-X' direction dimension than the magnet 200. The yoke 400 has a contact face 410.

Figure 2A:
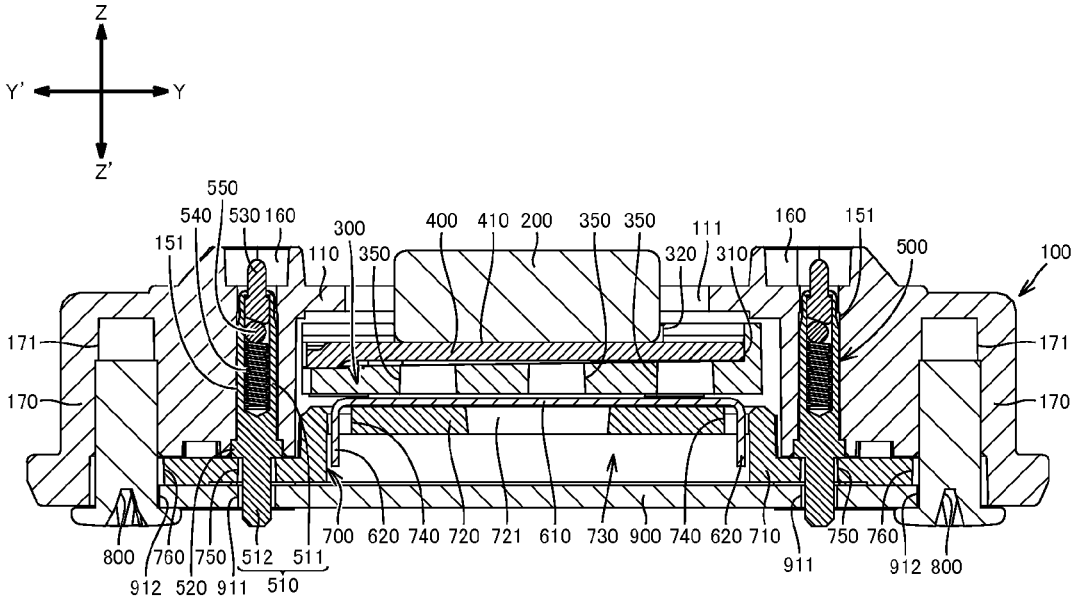
FIG. 2A is a cross-sectional view of the connector, taken along line 2A-2A in FIG. 1A.
Figure 2B:
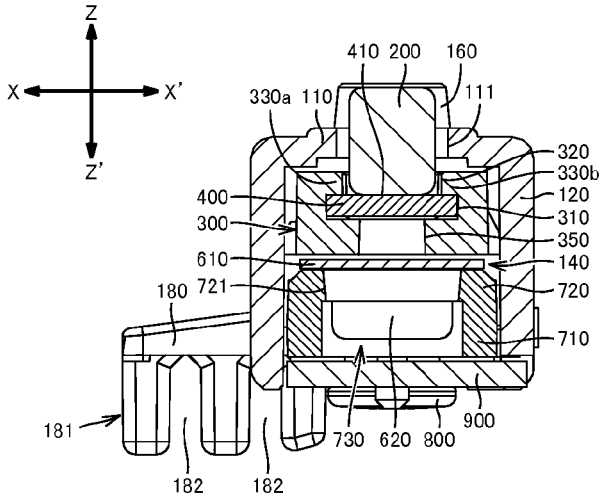
FIG. 2B is a cross-sectional view of the connector, taken along line 2B-2B in FIG. 1A.
Figure 2C:
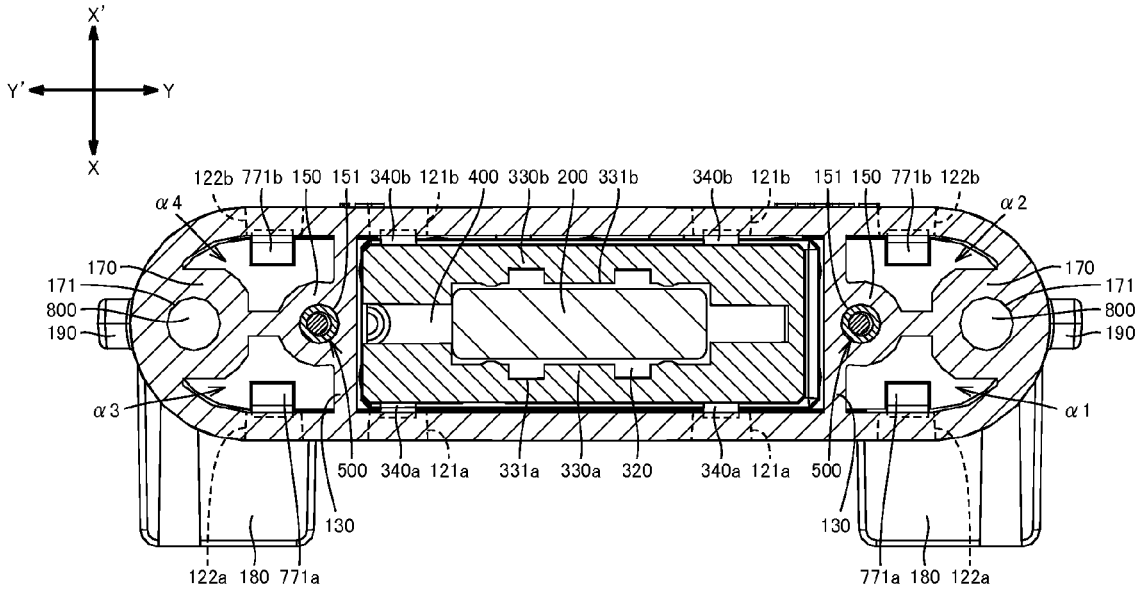
FIG. 2C is a cross-sectional view of the connector, taken along line 2C-2C in FIG. 1A.

As illustrated in FIGS. 2A to 2C, the holder 300 is a generally rectangular block of an insulating resin adapted to hold the magnet 200 and the yoke 400. The holder 300 has outer dimensions that are larger than the dimensions of an opening 111 (to be described) in the housing 100. The holder 300 has a Z-direction-side face (an upper face), a Z'-direction-side face (a lower face), side faces 301, 302, 303, and 304, a first accommodating portion 310, a second accommodating portion 320, mounting walls 330*a* and 330*b*, a plurality of first engaging portions 340*a* and 340*b*, and a plurality of holes 350.

Figure 3A:
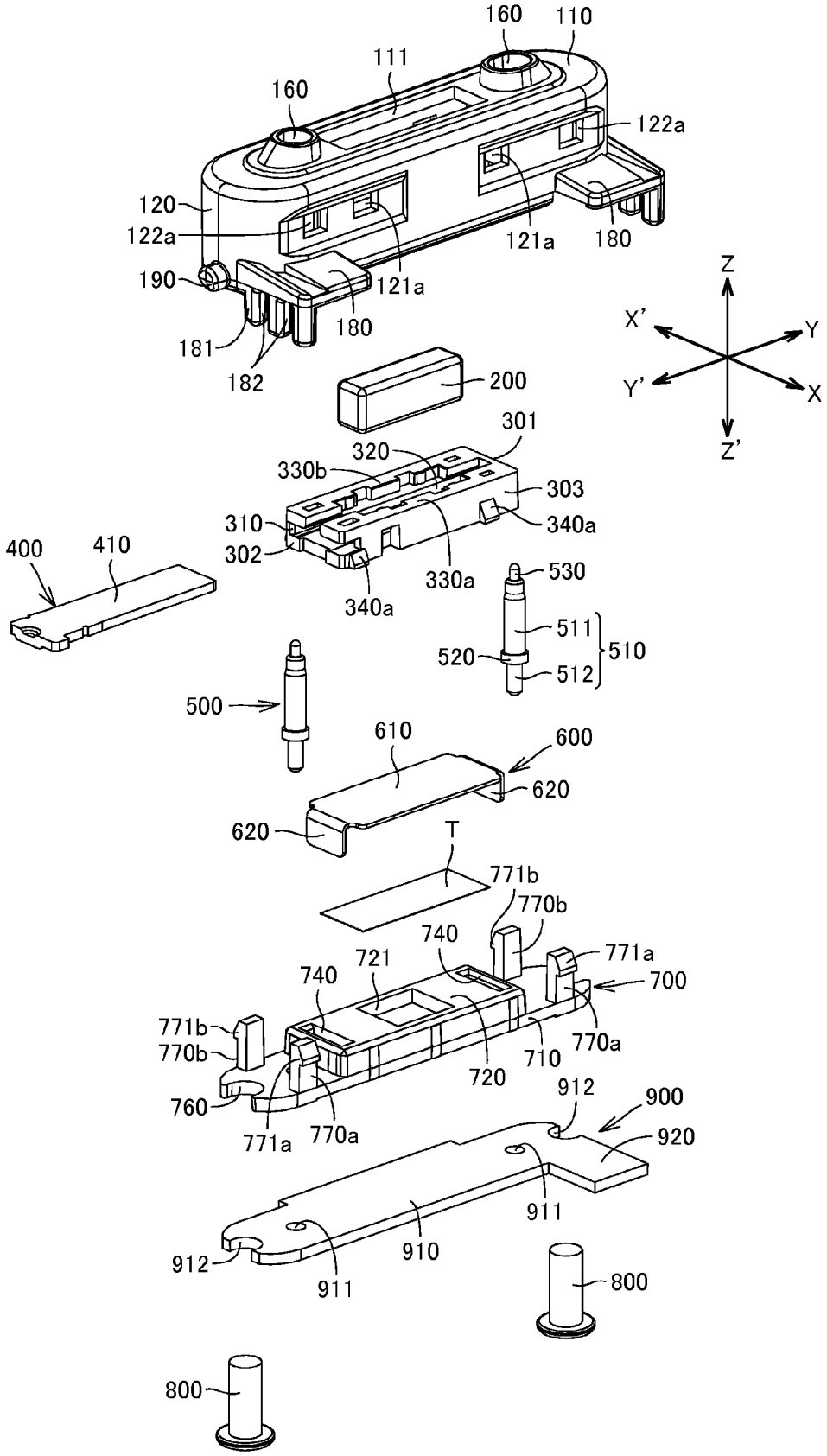
FIG. 3A is an exploded, front top left perspective view of the connector.
Figure 3B:
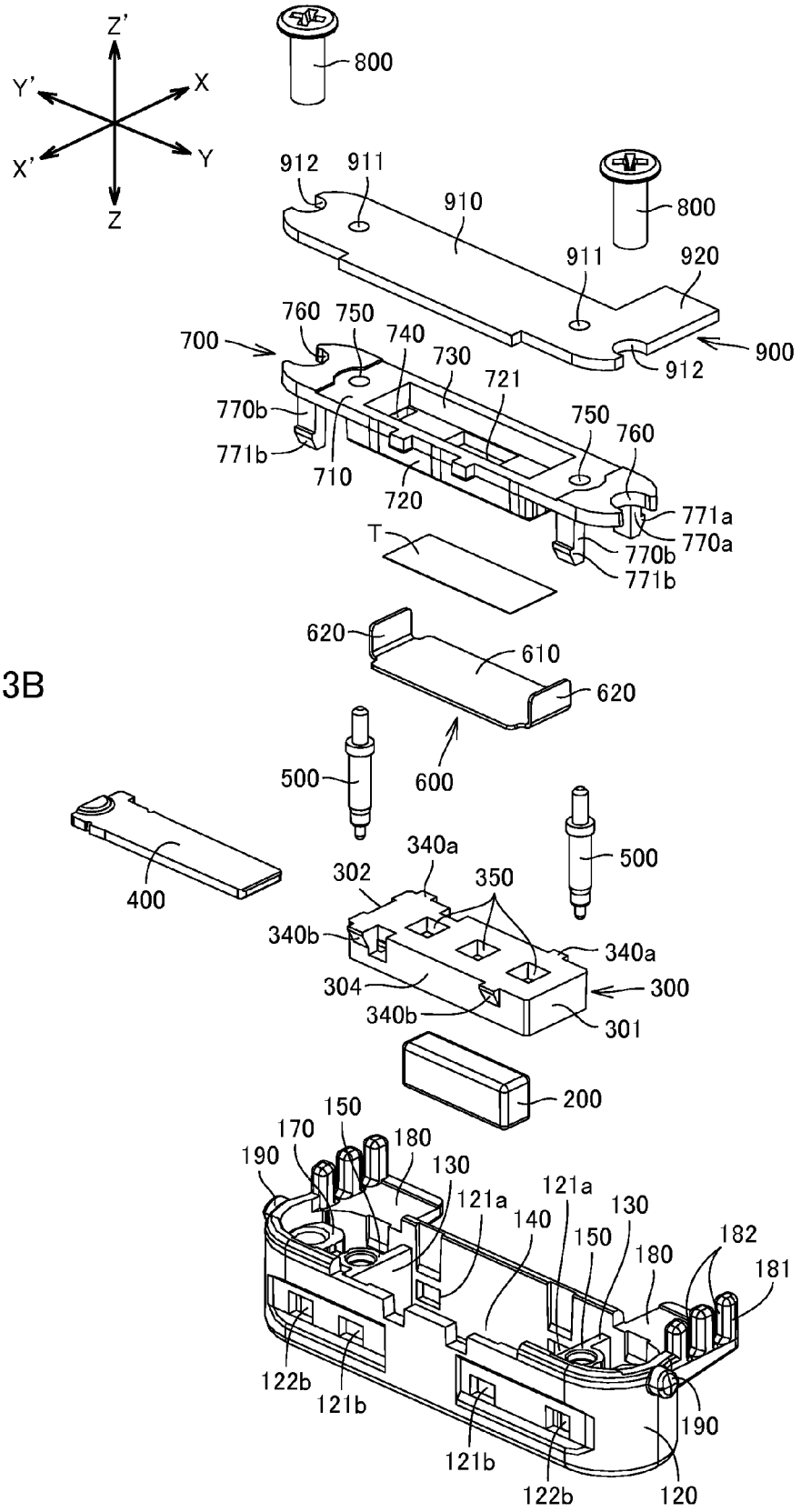
FIG. 3B is an exploded, rear bottom right perspective view of the connector.

As best illustrated in FIGS. 3A and 3B, the side faces 301 and 302 of the holder 300 are opposite to each other in the Y-Y' direction. The side faces 303 and 304 of the holder 300 are opposite to each other in the X-X' direction.

The first accommodating portion 310 is a generally rectangular recess, open at the side face 302 of the holder 300 and extending in the Y-Y' direction. The first accommodating portion 310 has a shape corresponding to the outer shape of the yoke 400. The yoke 400 is securely accommodated in the first accommodating portion 310 such that the contact face 410 is directed to the Z-direction side.

The second accommodating portion 320 is a recess open at the upper face of the holder 300 such as to communicate with the first accommodating portion 310. The second accommodating portion 320 has a Y-Y' direction dimension that is larger than that of the magnet 200 and smaller than that of the first accommodating portion 310. The second accommodating portion 320 has an X-X' direction dimension that is larger than that of the magnet 200 and smaller than that of the first accommodating portion 310. Accordingly, the contact face 410 of the yoke 400 is partially exposed through the second accommodating portion 320 to the outside of the holder 300. The second accommodating portion 320 accommodates the basal portion (Z'-direction-side portion) of the magnet 200 in contact with the contact face 410 of the yoke 400.

As best illustrated in FIGS. 2B and 2C, the mounting wall 330*a* is the wall on the X-direction side of the second accommodating portion 320, extending in the X' direction on and in contact with the contact face 410. The mounting wall 330*a* is disposed around (on the X-direction side of) and in spaced relation to the magnet 200. The mounting wall 330*a* has an inner face 331*a* facing the magnet 200. The inner face 331*a* has projections and depressions. The mounting wall 330*b* is the wall on the X' direction side of the second accommodating portion 320, extending in the X direction on and in contact with the contact face 410. The mounting wall 330*b* is disposed around (on the X' direction side of) and in spaced relation to the magnet 200. The mounting wall 330*b* has an inner face 331*b* facing the magnet 200. The inner face 331*b* has projections and depressions. The magnet 200 is bonded with adhesive (not shown) to the inner face 331*a* of the mounting wall 330*a*, the inner face 331*b* of the mounting wall 330*b*, and the area of the contact face 410 around the magnet 200.

As best illustrated in FIG. 3A, the first engaging portions 340*a* are provided on the side face 303 (first side face) of the holder 300, in spaced relation to each other in the Y-Y' direction. The first engaging portions 340*a* are engaging projections. The first engaging portions 340*a* each have a thickness in Z-Z' direction that gradually reduces toward the X-direction end. As best illustrated in FIG. 3B, the first engaging portions 340*b* are provided on the side face 304 (second side face) of the holder 300, in spaced relation to each other in the Y-Y' direction. The first engaging portions 340*b* are engaging projections. The first engaging portions 340*b* have a thickness in Z-Z' direction that gradually reduces toward the X' direction end.

As best illustrated in FIG. 2A, the holes 350 are through-holes extending from the bottom of the first accommodating portion 310 of the holder 300 to the lower face of the holder 300. The holes 350 are spaced from each other in the Y-Y' direction.

The housing 100 is made of an insulating resin. As illustrated in FIGS. 1A to 3B, the housing 100 includes a top 110, a peripheral wall 120, first and second partitions 130, an accommodating recess 140, first and second accommodating portions 150, first and second guides 160, first and second fixing portions 170, first and second legs 180, and first and second shafts 190.

As best illustrated in FIG. 3A, the top 110 is an insulating plate of generally elliptic shape. The rectangular opening 111 is open in the center of the top 110. The opening 111 extends through the top 110 in the Z-Z' direction. The opening 111 allows the distal portion (the Z-direction side portion) of the magnet 200 to project out of the housing 100. The peripheral edge of the opening 111 of the housing 100 faces the periphery of the upper face of the holder 300, with a space therebetween, because the opening 111 has dimensions that are larger than the outer dimensions of the magnet 200 and smaller than the outer dimensions of the holder 300. More specifically, the opening 111 has a Y-Y' direction dimension that is larger than that of the magnet 200 and smaller than that of the holder 300. The opening 111 has an X-X' direction dimension that is larger than that of the magnet 200 smaller than that of the holder 300.

As best illustrated in FIGS. 2C and 3B, the first partition 130 is a plate extending in the Z' direction from the Z'-direction-side face (the lower face) of the top 110, at the Y-direction side relative to the opening 111. The second partition 130 is a plate extending in the Z' direction from the lower face of the top 110, at the Y'-direction side relative to the opening 111. The partitions 130 and the top 110 define the accommodating recess 140. The accommodating recess 140 accommodates the holder 300, the yoke 400, and the basal portion of the magnet 200.

As best illustrated in FIGS. 2C and 3B, the first accommodating portion 150 is a circular tuboid body extending in the Z' direction from the lower face of the top 110, at the Y-direction side relative to the first partition 130. The second accommodating portion 150 is a circular tuboid body extending in the Z' direction from the lower face of the top 110, at the Y'-direction side relative to the second partition 130. The accommodating portions 150 each have an accommodating hole 151. The accommodating holes 151 extend in the Z-Z' direction through the top 110 and the accommodating portions 150, i.e. through the housing 100. The accommodating holes 151 have shapes corresponding to the outer shapes of the terminals 500.

As best illustrated in FIG. 2A, the guides 160 are tuboid bodies extending in the Z direction from the face on the Z-direction side (the upper face) of the top 110. The first and second guides 160 communicate with the accommodating holes 151 of the first and second accommodating portions 150, respectively.

As best illustrated in FIGS. 2C and 3B, the first fixing portion 170 is a circular tuboid body extending in the Z' direction from the lower face of the top 110, at the Y-direction side relative to the first accommodating portion 150. The first fixing portion 170 and the first accommodating portion 150 are connected by a first connecting wall. The second fixing portion 170 is a circular tuboid body extending in the Z' direction from the lower face of the top 110, at the Y'-direction side relative to the second accommodating portion 150. The second fixing portion 170 and the second accommodating portion 150 are connected by a second connecting wall. The fixing portions 170 each have a screw hole 171 extending in the Z-Z' direction.

As best illustrated in FIGS. 3A and 3B, the peripheral wall 120 is a generally elliptic tuboid body extending in the Z' direction from along the outer periphery of the lower face of the top 110. As best illustrated in FIG. 2C, the peripheral wall 120 and the first partition 130 define a Y-side space. In the Y-side space arranged are the first fixing portion 170, the first accommodating portion 150, and the first connecting wall. The first fixing portion 170, the first accommodating portion 150, and the first connecting wall divide the Y-side space further into two spaces, namely a first mounting space α1 and a second mounting space α2. The peripheral wall 120 and the second partition 130 define a Y'-side space. In the Y'-side space arranged are the second fixing portion 170, the second accommodating portion 150, and the second connecting wall are arranged. The second fixing portion 170, the second accommodating portion 150, and the second connecting wall divide the Y'-side space into two spaces, namely a third mounting space α3 and a fourth mounting space α4.

As best illustrated in FIG. 2C, the peripheral wall 120 has a plurality of second engaging portions 121*a* and 121*b*, and a plurality of third engaging portions 122*a* and 122*b*. The second engaging portions 121*a* are located at portions of the peripheral wall 120 corresponding to the first engaging portions 340*a* of the holder 300. The second engaging portions 121*a* are engaging holes extending in the X-X' direction through the peripheral wall 120 and engage with the first engaging portions 340*a* such that the first engaging portions 340*a* are movable in the Y-Y' direction. The second engaging portions 121*b* are located at portions of the peripheral wall 120 corresponding to the first engaging portions 340*b* of the holder 300. The second engaging portions 121*b* are engaging holes extending in the X-X' direction through the peripheral wall 120 and engage with the first engaging portions 340*b* such that the first engaging portions 340*b* are movable in the Y-Y' direction. As the second engaging portions 121*a* and 121*b* engage with the first engaging portions 340*a* and 340*b*, respectively, movably in the Y-Y' direction, the floatable unit (the combination of the holder 300, the yoke 400, and the magnet 200) is floatingly movable inside the accommodating recess 140 of the housing 100. It should be appreciated that the floatable unit is at a neutral position when the first engaging portions 340*a* and 340*b* abut the edges in the Z' direction of the second engaging portions 121*a* and 121*b*, respectively.

The third engaging portions 122*a* are engaging holes extending through the peripheral wall 120 in the X-X' direction so as to communicate with the first mounting space α1 and the third mounting space α3, respectively. The third engaging portions 122*b* are engaging holes extending through the peripheral wall 120 in the X-X' direction so as to communicate with the second mounting space α2 and the fourth mounting space α4, respectively.

The first leg 180 extends in the X direction from the Y-direction end of the X-direction-side wall of the peripheral wall 120. The first leg 180 includes teeth 181 extending in the Z direction and being spaced with slits 182. The second leg 180 extends in the X direction from the Y'-direction end of the X-direction-side wall of the peripheral wall 120. The second leg 180 is a mirror image of the first leg in the Y-Y' direction. The first shaft 190 is a circular tuboid body extending in the Y direction from the Y-direction end of the peripheral wall 120. The second shaft 190 is a circular tuboid body extending in the Y' direction from the Y'-direction end of the peripheral wall 120.

As best illustrated in FIG. 2A, the terminals 500 are spring pins held in the housing 100 and connected to the circuit board 900. Each terminal 500 has a barrel 510, a flange 520, a plunger 530, a biasing part 540, and an insulator 550. The barrel 510 is electrically conductive. The barrel 510 includes a tube 511 and a connecting portion 512. The tube 511 is a bottomed tube opening in the Z direction. The tube 511 is accommodated in the accommodating hole 151 of each accommodating portion 150 of the housing 100. The connecting portion 512 is a cylinder extending in the Z' direction from the bottom of the tube 511. The flange 520 is a disc standing out from the circumference of the barrel 510. The flange 520 has an outside diameter that is larger than the diameter of the step in the accommodating hole 151, so that the flange 520 abuts the step in the accommodating hole 151 of the accommodating portion 150. The plunger 530 is electrically conductive. The plunger 530 is accommodated in the tube 511 of the barrel 510 so as to be slidable in the Z-Z' direction. The plunger 530 is electrically connected to the barrel 510 by contacting the inner face of the tube 511. The biasing part 540 is a coil spring accommodated in the tube 511 of the barrel 510 and biasing the plunger 530 in the Z direction (the direction projecting the plunger 530 from the barrel). The biasing force make the Z-direction end portion of the plunger 530 project from the tube 511 and the accommodating hole 151 into the guide 160. The insulator 550 is a spherical body interposed for insulation between the plunger 530 and the biasing part 540.

As best illustrated in FIGS. 2A and 2B, the closing member 700 is made of an insulating resin and fixed into the housing 100 to close the accommodating recess 140 and the first to fourth mounting spaces α1 to α4 of the housing 100. The closing member 700 includes a base 710, a projection 720, a recess 730, first and second receiving holes 740, first and second through-holes 750, first and second cut-outs 760, first and second engaging arms 770*a*, and first and second engaging arms 770*b*.

The base 710 is a plate of generally elliptic shape corresponding to the inner shape of the housing 100. The base 710 serves to close the first to fourth mounting spaces α1 to α4 of the housing 100 from the Z'-direction side. The projection 720 is a generally rectangular projection extending in the Z direction from the center of the base 710. The outer shape of the projection 720 corresponds to the inner shape of the accommodating recess 140 of the housing 100. The projection 720 is inserted into the accommodating recess 140 of the housing 100 so as to close the accommodating recess 140 from the Z' direction side. The projection 720 has an opening 721 opening in the Z direction. The recess 730 is a generally rectangular recess in the face on the Z'-direction side of the base 710 and communicates with the opening 721.

The first receiving hole 740 is provided in the projection 720, at the Y-direction side relative to the opening 721. The second receiving hole 740 is provided in the projection 720, at the Y'-direction side relative to the opening 721. The first through-hole 750 is provided in the base 710, at the Y-direction side relative to the projection 720. The second through-hole 750 is provided in the base 710, at the Y'-direction side relative to the projection 720. The through-holes 750 receive therethrough the connecting portions 512 of the terminals 500. The edges of the through-holes 750 of the base 710 abut on the flanges 520 of the terminals 500 because the diameter of the through-holes 750 is slightly larger than the outer diameter of the connecting portions 512 of the terminals 500. The first cut-out 760 is provided at the Y-direction end of the base 710, and the second cut-out 760 is provided at the Y'-direction end of the base 710. The cut-outs 760 communicate with the respective screw holes 171 of the fixing portions 170 of the housing 100. The cut-outs 760 each have a diameter corresponding to the outer diameter of each screw 800.

The first and second engaging arms 770*a* extend in the Z direction from portions of the base 710 at the X-direction side relative to the first and second through-holes 750. The first engaging arm 770*a* is accommodated in the first mounting space α1, and the second engaging arm 770*a* is accommodated in the third mounting space α3. The end of each engaging arm 770*a* is provided with a hook 771*a*. The hooks 771*a* engage in the third engaging portions 122*a* of the housing 100. The first and second engaging arms 770*b* extend in the Z direction from portions of the base 710 at the X'-direction side relative to the first and second through-holes 750. The first engaging arm 770*a* is accommodated in the second mounting space α2, and the second engaging arm 770*a* is accommodated in the fourth mounting space α4. The end of each engaging arm 770*b* is provided with a hook 771*b*. The hooks 771*b* engage in the third engaging portions 122*b* of the housing 100.

The shield member 600 is a electrically conductive plate fixed to the closing member 700 and accommodated in the accommodating recess 140 of the housing 100 together with the projection 720 of the closing member 700. The shield member 600 includes a shield plate 610, and first and second shoulders 620. The shield plate 610 is a generally rectangular plate fixed to the face on the Z-direction side of the projection 720 of the closing member 700 with a double-faced adhesive tape T. The shield member 600 is spaced from the holder 300 inside the accommodating recess 140. The shield member 600 is attracted to the magnet 200, and the floatable unit is thereby held in the neutral position. The first shoulder 620 is a plate extending in the Z' direction from the Y-direction end of the shield plate 610. The first shoulder 620 is received in the first inserting hole 740 of the projection 720. The second shoulder 620 is a plate extending in the Z' direction from the Y'-direction end of the shield plate 610. The second shoulder 620 is received in the second receiving hole 740 of the projection 720.

The circuit board 900 is disposed at the Z' direction side relative to the closing member 700 (at the other side of the thickness direction of the closing member 700). The circuit board 900 has a board body 910 and a connecting portion 920. The outer shape of the board body 910 is substantially the same as the outer shape of the base 710 of the closing member 700. The board body 910 abuts on the face on the Z'-direction side of the base 710. The board body 910 has first and second through-hole electrodes 911 and first and second cut-outs 912. The first through-hole electrode 911 in the board body 910 communicates with the first through-hole 750 of the closing member 700. The second through-hole electrode 911 in the board body 910 communicates with the second through-hole 750 of the closing member 700. The connecting portions 512 of the terminals 500 are received in and electrically connected to the through-hole electrodes 911. The first cut-outs 912 is provided at the Y-direction end of the board body 910 so as to communicate with the first cut-out 760. The second cut-out 912 is provided at the Y'-direction end of the board body 910 so as to communicate with the second cut-out 760. The diameter of each cut-out 912 corresponds to the outer diameter of each screw 800.

The connecting portion 920 extends in the X direction from the Y-direction end of the board body 910. The connecting portion 920 abuts on the face on the Z' direction side (the lower face) of the first leg 180 of the housing 100. The connecting portion 920 is connectable to lead wires for external connection (not shown). The lead wires are partially insertable into the slits 182 of the first leg 180. The slits 182 each have a width slightly smaller than the outside diameter of each lead wire so as to allow the slits 182 to hold the lead wire partially.

The first screw 800 extends through the first cut-out 912 of the circuit board 900 and the first cut-out 760 of the closing member 700, and screwed in the screw hole 171 of the first fixing portion 170 of the housing 100. The second screw 800 extends through the second cut-out 912 of the circuit board 900 and the second cut-out 760 of the closing member 700, and screwed in the screw hole 171 of the second fixing portion 170 of the housing 100.

A method for manufacturing the connector C1 will be described below. First, the yoke 400 and the holder 300 are prepared. The yoke 400 is inserted into the first accommodating portion 310 of the holder 300 such that the contact face 410 of the yoke 400 is exposed from the second accommodating portion 320 to the outside of the holder 300. The yoke 400 is thus held in the holder 300. The magnet 200 is prepared. The magnet 200 is inserted into the second accommodating portion 320 of the holder 300 and placed on the contact face 410 of the yoke 400. The mounting walls 330*a* and 330*b* of the holder 300 are now arranged around the magnet 200 with spaces therebetween. The adhesive is applied into the spaces to bond the magnet 200 to the mounting walls 330*a* and 330*b* and the contact face 410 of the yoke 400. The floatable unit is thus assembled.

The housing 100 is also prepared. The floatable unit is inserted into the accommodating recess 140 of the housing 100 from the Z'-direction side, and the magnet 200 of the floatable unit is inserted into the opening 111 of the housing 100. The first engaging portions 340*a* and 340*b* of the holder 300 of the floatable unit are engaged into the second engaging portions 121*a* and 121*b*, respectively, of the housing 100. The floatable unit is thus accommodated in the housing 100 in a floatable manner.

The terminals 500 are also prepared. The terminals 500 are inserted into the accommodating holes 151 of the housing 100. The flanges 520 of the terminals 500 are thus brought into abutment with the steps of the accommodating holes 151.

The shield member 600 and the closing member 700 are also prepared. The shoulders 620 of the shield member 600 are inserted into the receiving holes 740 of the closing member 700. The shield plate 610 of the shield member 600 is bonded to the projection 720 with the double-faced tape T. The shield member 600 and the projection 720 of the closing member 700 are inserted into the accommodating recess 140 of the housing 100. The closing member 700 now closes the accommodating recess 140 and the first to fourth mounting spaces α1 to α4 of the housing 100. Simultaneously, the engaging arms 770*a* of the closing member 700 are inserted into the first mounting space α1 and the third mounting space α3, and the engaging arms 770*b* are inserted into the second mounting space α2 and the fourth mounting space α4. As a result, the hooks 771*a* of the engaging arms 770*a* are engaged into the third engaging portions 122*a* of the housing 100, while the hooks 771*b* of the engaging arms 770*b* are engaged into the third engaging portions 122*b* of the housing 100. The closing member 700 is thus attached to the housing 100.

As to the terminals 500 accommodated in the accommodating holes 151 of the housing 100, the connecting portions 512 are inserted through the through-holes 750 of the closing member 700, and the flanges 520 are brought into abutment with the closing member 700. As a result, the housing 100 and the closing member 700 directly hold the flanges 520 therebetween. The cut-outs 760 of the closing member 700 now communicate with the screw holes 171 of the housing 100.

Also prepared is the circuit board 900 with lead wires connected thereto. The circuit board 900 is brought into abutment with the face on the Z'-direction side of the closing member 700. At this time, the connecting portions 512 of the terminals 500 projected from the through-holes 750 are inserted into and electrically connected to the through-hole electrodes 911 of the circuit board 900. The cut-outs 912 of the circuit board 900 now communicate with the cut-outs 760 of the closing member 700. The screws 800 are also prepared. The screws 800 are inserted into the cut-outs 912 and then into the cut-outs 760, and they are screwed into the screw holes 171 of the housing 100. The circuit board 900 is thus attached to the housing 100. The lead wires are inserted into the slits 182 of the housing 100 such that the slits 182 hold the respective lead wires partially. This is how to manufacture the connector C1.

An electronic device of the first embodiment of the invention will be described below with reference to FIG. 4. The electronic device is a charging device for a mobile terminal (a connection object), such as a smartphone. The electronic device includes the connector C1 and a cabinet 10.

The cabinet 10 is an insulating resin case for accommodating the connector C1 and other components. The cabinet 10 includes a cabinet body 11 and a protective cover 12. The cabinet body 11 incorporates a circuit board (not shown), to which the connector C1 is connected via the lead wires. The cabinet body 11 has a mounting recess 11*a*. An opening (now shown) is provided at the center of the bottom of the mounting recess 11*a*.

The protective cover 12 is made of an insulating resin and has a generally U-shaped cross-section as viewed in the X-X' direction. The protective cover 12 fits in the mounting recess 11*a* of the cabinet body 11 and adapted to receive a mobile terminal. The protective cover 12 includes a bottom and walls, and the walls extend in the Z direction from the opposite ends in the X-X' direction of the bottom. The bottom of the protective cover 12 has an opening 12*a* in communication with the opening of the cabinet body 11. The connector C1 is disposed in the cabinet body 11 such as to be exposed to the outside of the cabinet 10 through the opening of the cabinet body 11 and the opening 12*a* of the protective cover 12.

When a mobile terminal is inserted into the protective cover 12, the distance between a magnetic body of the mobile terminal and the magnet 200 of the connector C1 becomes smaller than the distance from the magnet 200 to the shield member 600. This arrangement allows the magnet 200 of the connector C1 to be attracted to the magnetic body. During the insertion of the mobile terminal, the floatable unit floatingly moves from neutral position inside the accommodating recess 140 of the housing 100 in accordance with the orientation of the magnetic body. Also, the terminals of the mobile terminal are inserted into the guides 160 of the housing 100, and the plungers 530 of the terminals 500 are pressed onto terminals of the mobile terminal. The biasing parts 540 are compressed between the plungers 530 and the bottoms of the tubes 511, and the plungers 530 are thereby brought into contact at a predetermined contact pressure with the terminals of the mobile terminal. This is how to connect the connector C1 to the mobile terminal.

The connector C1 and the electronic device described above have at least the following technical features. First, it is possible to improve the bonding strength of the magnet 200 to the holder 300. This is because the magnet 200 is bonded to the mounting walls 330*a* and 330*b* of the holder 300 and the area of the yoke 400 around the magnet 200. This arrangement can provide increased bonding area of the magnet 200 to the holder 300 and the yoke 400. Hence the connector C1 is configured suitably for downsizing.

Second, the floatable unit can be easily assembled for the following reasons. The yoke 400 is accommodated and held in the first accommodating portion 310 of the holder 300 so that the contact face 410 of the yoke 400 is partially exposed to the outside of the holder 300 through the second accommodating portion 320 of the holder 300. This arrangement makes it possible to bond the magnet 200 to the holder 300 and fix of the magnet 200 to the yoke 400 at one time simply, simply by inserting the magnet 200 into the second accommodating portion 320 of the holder 300 to bring the magnet 200 into contact with the contact face 410 of the yoke 400 and by bonding the magnet 200 to the mounting walls 330*a* and 330*b* of the holder 300 and the yoke 400.

Third, the holder 300, the magnet 200, and the yoke 400 are held in the housing 100 in a floatable manner with a simple structure. Specifically, the structure is such that the first engaging portions 340*a* and 340*b*, which serve as the engaging projections of the holder 300, are held in the second engaging portions 121*a* and 121*b*, which serve as the engaging holes of the housing 100, so as to allow the first engaging portions 340*a* and 340*b* to move in the Z-Z' direction.

Fourth, the connector C1 can be easily assembled. This is because the floatable unit, the terminals 500, the closing member 700, and the circuit board 900 can be all incorporated into the housing 100 from the Z' direction side. In addition, the flanges 520 of the terminals 500 are held between the steps of the accommodating holes 151 of the housing 100 and the closing member 700, obviating a step of fixing the terminals 500 to the housing 100.

Fifth, it is possible to reduce magnetic influence of the magnet 200 on the circuit board 900. This is because the shield member 600 is disposed between the magnet 200 and the circuit board 900.

Sixth, the lead wires connected to the circuit board 900 can be easily fixed into the housing 100. This is because the lead wires can be simply inserted into the slits 182 of the associated leg 180 of the housing 100.

Second Embodiment

A connector C2 of the second embodiment of the invention will be described below with reference to FIGS. 5A to 7B. The connector C2 has substantially the same configuration as the connector C1, except that the floatable unit of the connector C2 has a different structure from that of the floatable unit of the connector C1. The differences will be described below in detail, but the features of the connector C2 overlapping with the connector C1 will be omitted. A symbol _↑_ is each reference numeral for the holder of the floatable unit and its sub-elements of this embodiment for the purpose of distinction from the holder 300 of the floatable unit and its sub-elements of the connector C1. The Y-Y' direction indicated in FIGS. 6A, 6C, 7A, and 7B is the longitudinal direction of the connector C2 and equivalent to the first direction in the claims. The X-X' direction indicated in FIGS. 6B, 6C, 7A, and 7B is the short direction of the connector C2 and perpendicular to the Y-Y' direction. The Z-Z' direction indicated in FIGS. 6A, 6B, 7A, and 7B is the height direction of the connector C2 and equivalent to the second direction in the claims and to the thickness direction of the closing member 700. The Z direction is equivalent to one side of the thickness direction, and the Z' direction is equivalent to the other side of the thickness direction. The Z-Z' direction is perpendicular to the Y-Y' and X-X' directions.

Figure 6A:
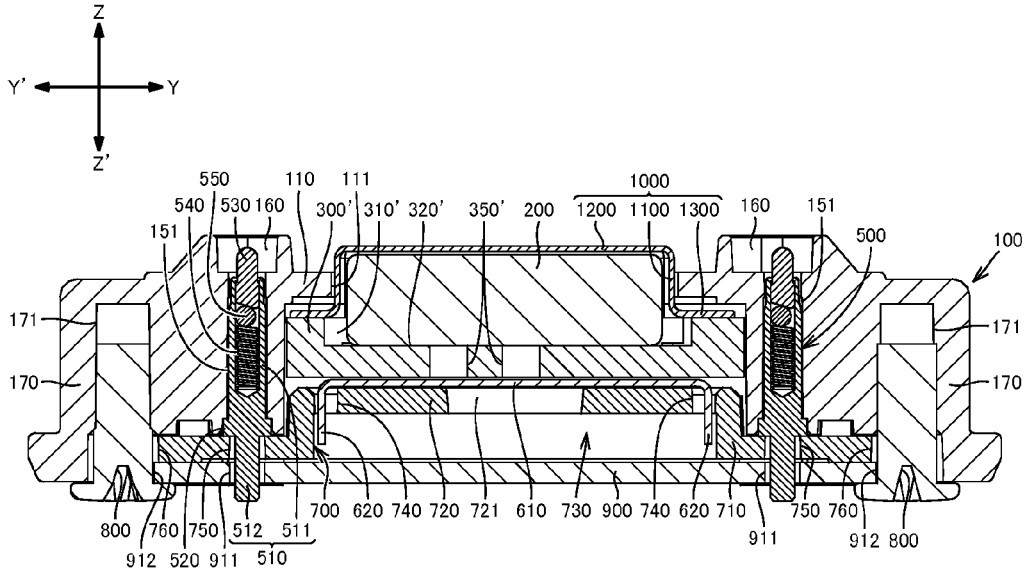
FIG. 6A is a cross-sectional view of the connector, taken along line 6A-6A in FIG. 5A.
Figure 6B:
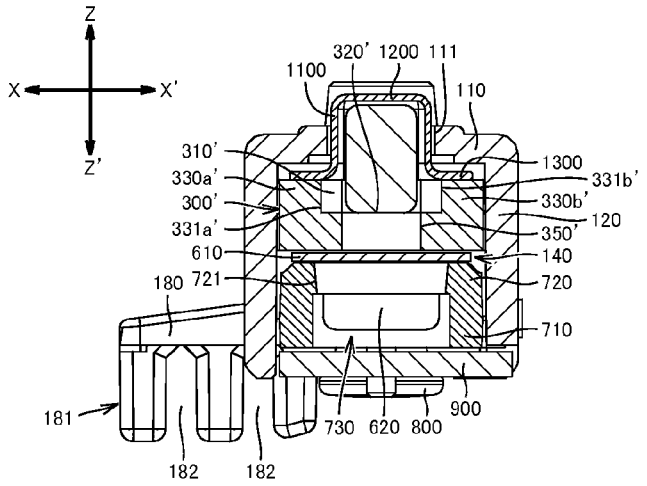
FIG. 6B is a cross-sectional view of the connector, taken along line 6B-6B in FIG. 5A of the connector.
Figure 6C:
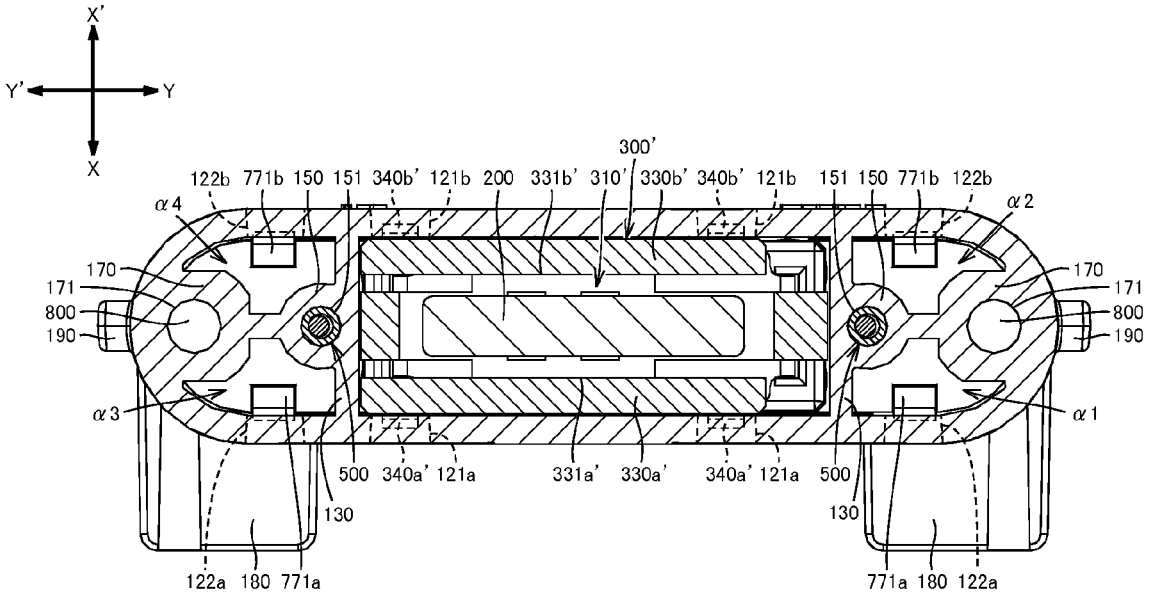
FIG. 6C is a cross-sectional view of the connector, taken along line 6C-6C in FIG. 5A of the connector.

The floatable unit of the connector C2 includes the magnet 200, a holder 300', and a cover 1000. As illustrated in FIGS. 6A to 6C, the holder 300' is a generally rectangular block of an insulating resin adapted to hold the magnet 200. The holder 300' has a Z-direction-side face (an upper face), a Z'-direction-side face (a lower face), side faces 301', 302', 303', and 304', an accommodating portion 310', a contact face 320', mounting walls 330*a*' and 330*b*', a plurality of first engaging portions 340*a*' and 340*b*', and a plurality of holes 350'.

Figure 7A:
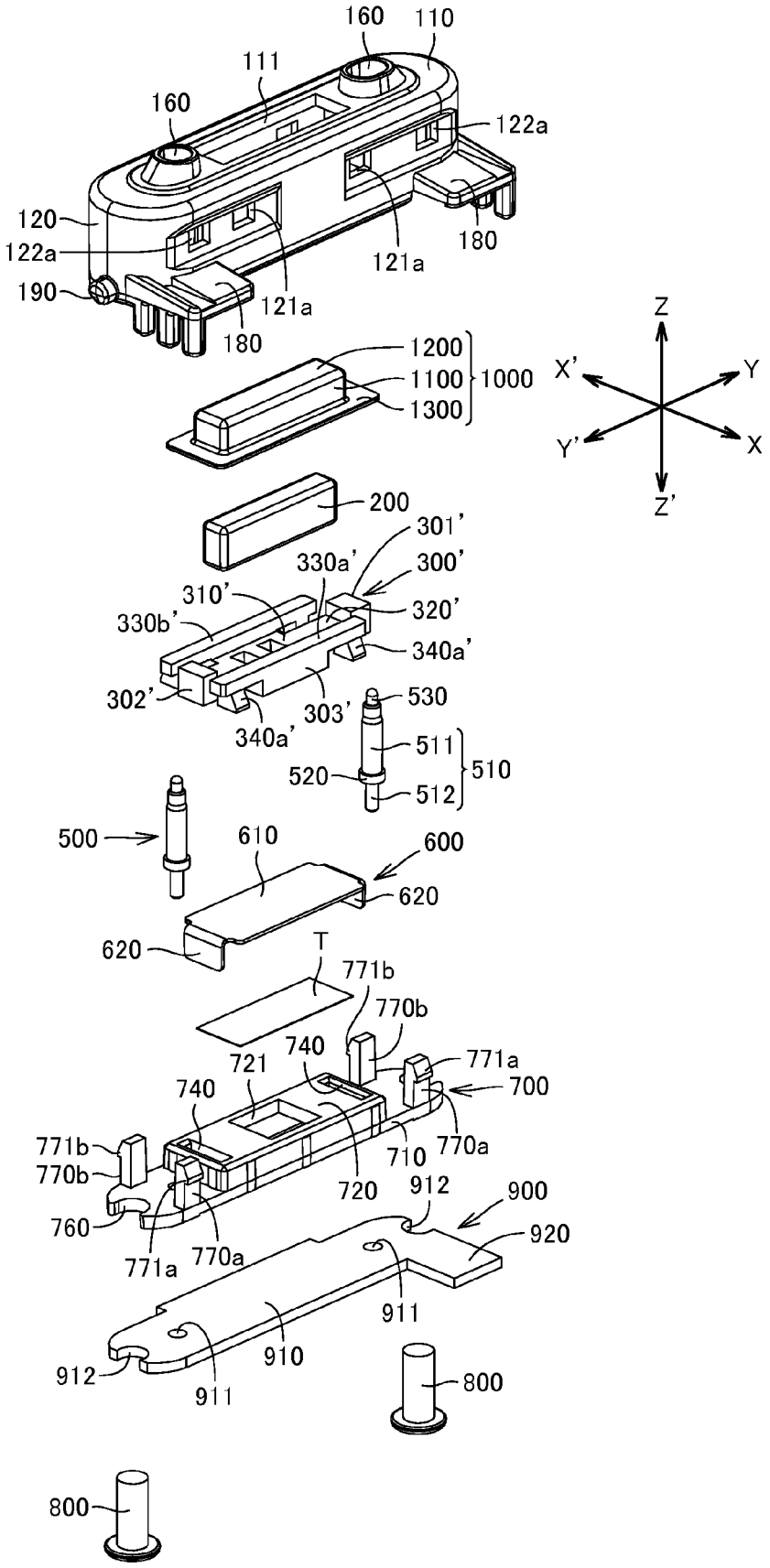
FIG. 7A is an exploded, front top left perspective view of the connector.
Figure 7B:
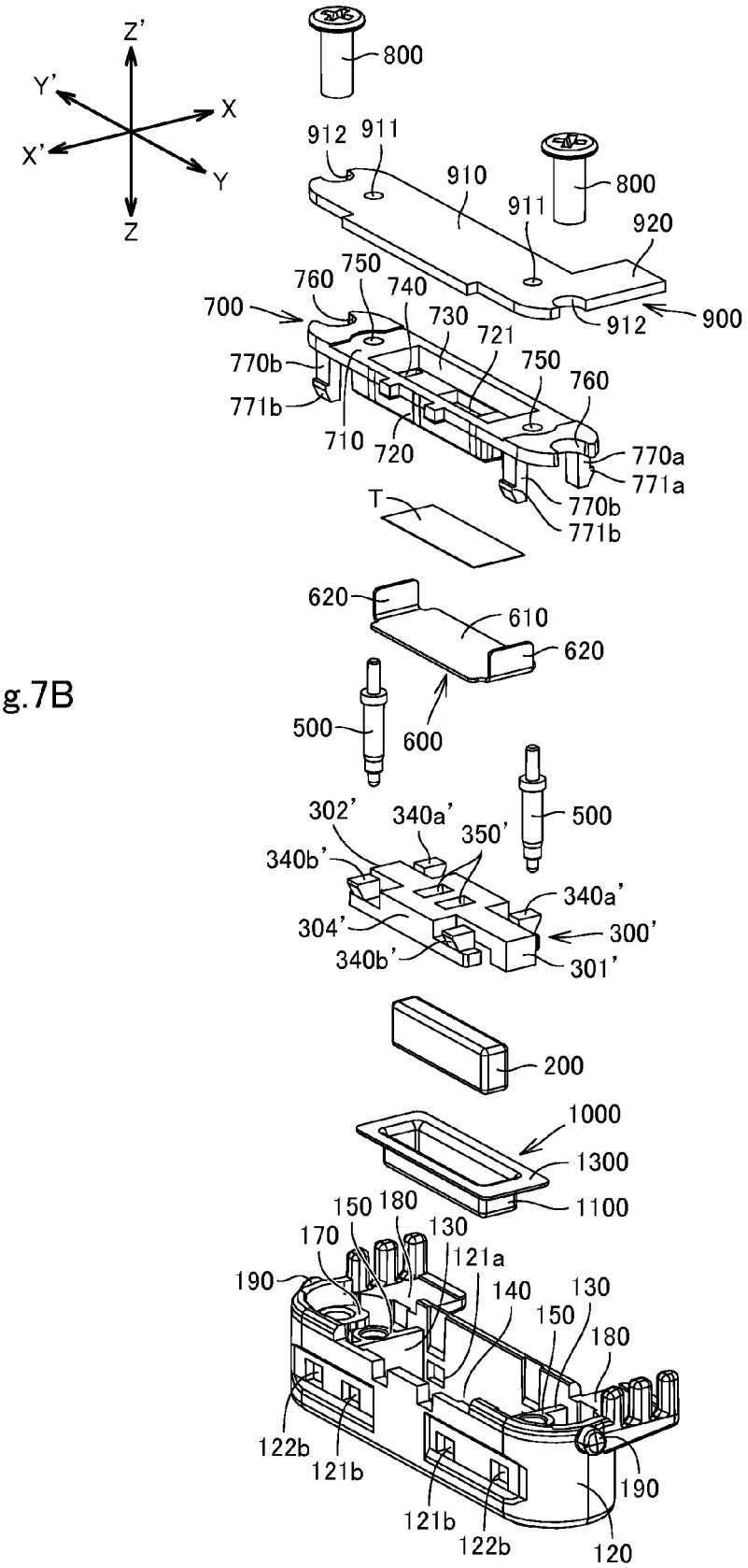
FIG. 7B is an exploded, rear bottom right perspective view of the connector.

As best illustrated in FIGS. 7A and 7B, the side faces 301' and 302' of the holder 300' are opposite to each other in the Y-Y' direction. The side faces 303' and 304' of the holder 300' are opposed to each other in the X-X' direction. The side faces 301' to 304' of the holder 300' are cut away partially.

The accommodating portion 310' is a generally rectangular recess in the upper face of the holder 300' and extends in the Y-Y' direction. The contact face 320' is the bottom of the accommodating portion 310'. The accommodating portion 310' is larger in Y-Y' direction dimension than the magnet 200. The basal portion (Z'-direction-side portion) of the magnet 200 is accommodated in the accommodating portion 310' and is in contact with the contact face 320'.

As best illustrated in FIGS. 6B and 6C, the mounting wall 330*a*' is the wall on the X-direction side of the accommodating portion 310' and disposed around (on the X-direction side of) the magnet 200 and the contact face 320'. The mounting wall 330*a*' is spaced from the magnet 200. The mounting wall 330*a*' has a flat inner face 331*a*' facing the magnet 200. The mounting wall 330*b*' is the wall on the X'-direction side of the accommodating portion 310' and disposed around (on the X'-direction side of) the magnet 200 and the contact face 320'. The mounting wall 330*b*' is spaced from the magnet 200. The mounting wall 330*b*' has a flat inner face 331*b*' facing the magnet 200. The magnet 200 is bonded with adhesive (now shown) to the inner face 331*a*' of the mounting wall 330*a*', the inner face 331*b*' of the mounting wall 330*b*', and the area of the contact face 320' around the magnet 200.

As best illustrated in FIG. 7A, the first engaging portions 340*a*' are provided on the side face 303' (first side face) of the holder 300', in spaced relation to each other in the Y-Y' direction. The first engaging portions 340*a*' are engaging projections. The first engaging portions 340*a*' each have a thickness in Z-Z' direction that gradually reduces toward the X-direction end. The first engaging portions 340*a*' engage in the second engaging portions 121*a* of the housing 100 such as to be movable in the Y-Y' direction. As best illustrated in FIG. 7B, the first engaging portions 340*b*' are provided on the side face 304' (second side face) of the holder 300', in spaced relation to each other in the Y-Y' direction. The first engaging portions 340*b*' are engaging projections. The first engaging portions 340*b*' each have a thickness in Z-Z' direction that gradually reduces toward the X'-direction end. The first engaging portions 340*b*' engage in the second engaging portions 121*b* of the housing 100 such as to be movable in the Y-Y' direction.

As illustrated in FIG. 6A, the holes 350' are through-holes extending from the contact face 320' of the holder 300' to the lower face of the holder 300'. The holes 350' are spaced from each other in the Y-Y' direction.

The cover 1000 is a metal plate covering the magnet 200. The cover 1000 in combination with the magnet 200 is partially exposed through the opening 111 of the housing 100 to the outside of the housing 100. The cover 1000 has a tube 1100, a top plate 1200, and a flange 1300. The tube 1100 is a square tuboid body covering the side faces of the magnet 200 excluding the basal portions thereof. The top plate 1200 is a generally rectangular plate joined to the Z-direction ends of the tube 1100 so as to close the opening on the Z-direction side of the tube 1100. The top plate 1200 covers the end face on the Z-direction side (the upper face) of the magnet 200. The flange 1300 is a square frame-shaped plate extending outward from the Z'-direction ends of the tube 1100 and abuts on the peripheral portion of the upper face of the holder 300'. The outer dimensions of the flange 1300 are larger than the dimensions of the opening 111 of the housing 100. The flange 1300 faces the peripheral edges of the opening 111 of the housing 100 in spaced relation to each other. In other words, the flange 1300 is abuttable onto the peripheral edges of the opening 111 of the housing 100 from the inside of the housing 100. The flange 1300 can prevent the cover 1000 from falling off through the opening 111 of the housing 100.

A method for manufacturing the connector C2 will be described below. First, the holder 300' and the magnet 200 are prepared. The magnet 200 is inserted into the accommodating portion 310' of the holder 300', and placed on the contact face 320' of the holder 300'. The mounting walls 330*a*' and 330*b*', of the holder 300' are now arranged around the magnet 200 with spaces therebetween. The adhesive is applied into the spaces to bond the magnet 200 to the mounting walls 330*a*' and 330*b*', and the contact face 320'. The cover 1000 is prepared. The magnet 200 is inserted into the tube 1100 of the cover 1000. The magnet 200 is now covered by the cover 1000, and the flange 1300 of the cover 1000 is brought into abutment with the peripheral area of the upper face of the holder 300'. The floatable unit is thus assembled.

The housing 100 is also prepared. The floatable unit is inserted into the accommodating recess 140 of the housing 100 from the Z'-direction side. The top plate 1200 and the tube 1100 of the cover 1000 and the magnet 200 of the floatable unit are inserted into the opening 111 of the housing 100. The first engaging portions 340*a*' and 340*b*' of the holder 300' of the floatable unit are engaged into the second engaging portions 121*a* and 121*b*, respectively, of the housing 100. The floatable unit is thus accommodated floatably in the housing 100. The subsequent steps for manufacturing the connector C2 are the same as these for manufacturing the connector C1 and therefore will not be repeated here.

Figure 4:
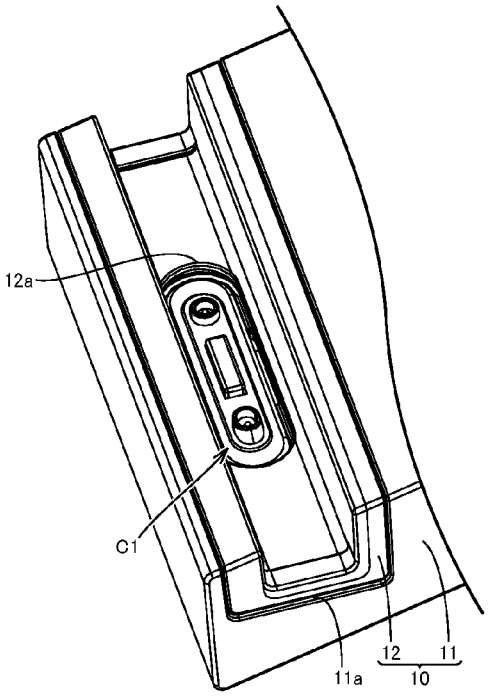
FIG. 4 is a perspective view of part of an electronic device according to the first embodiment of the invention.
Figure 5A:
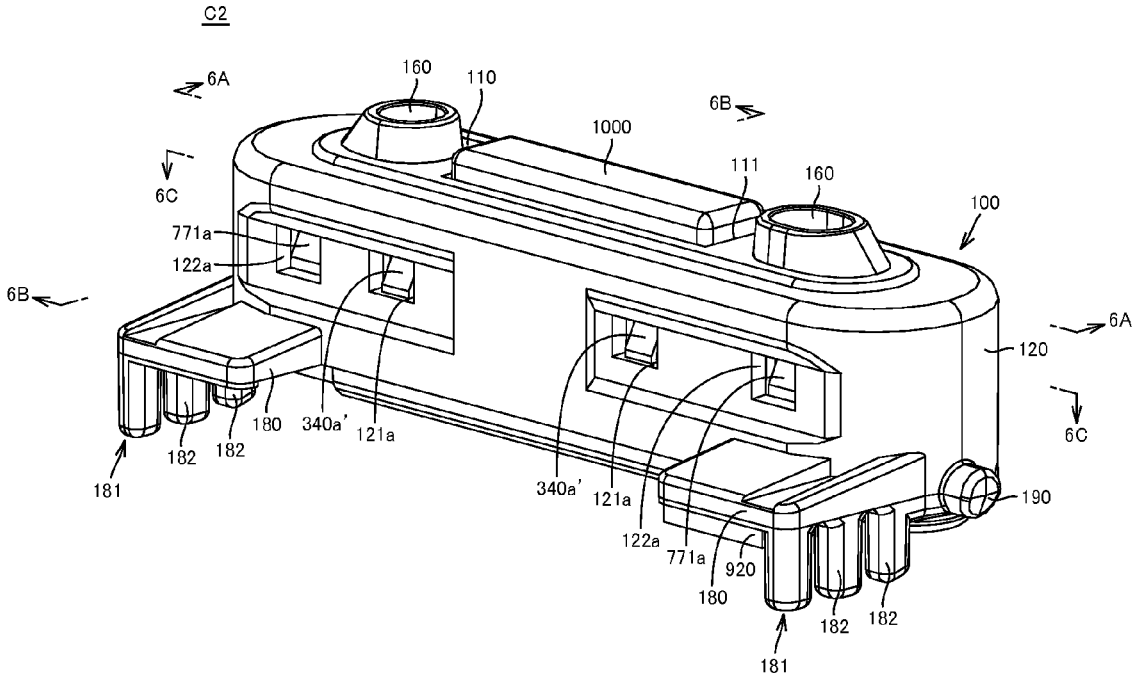
FIG. 5A is a front top right perspective view of a connector according to the second embodiment of the invention.
Figure 5B:
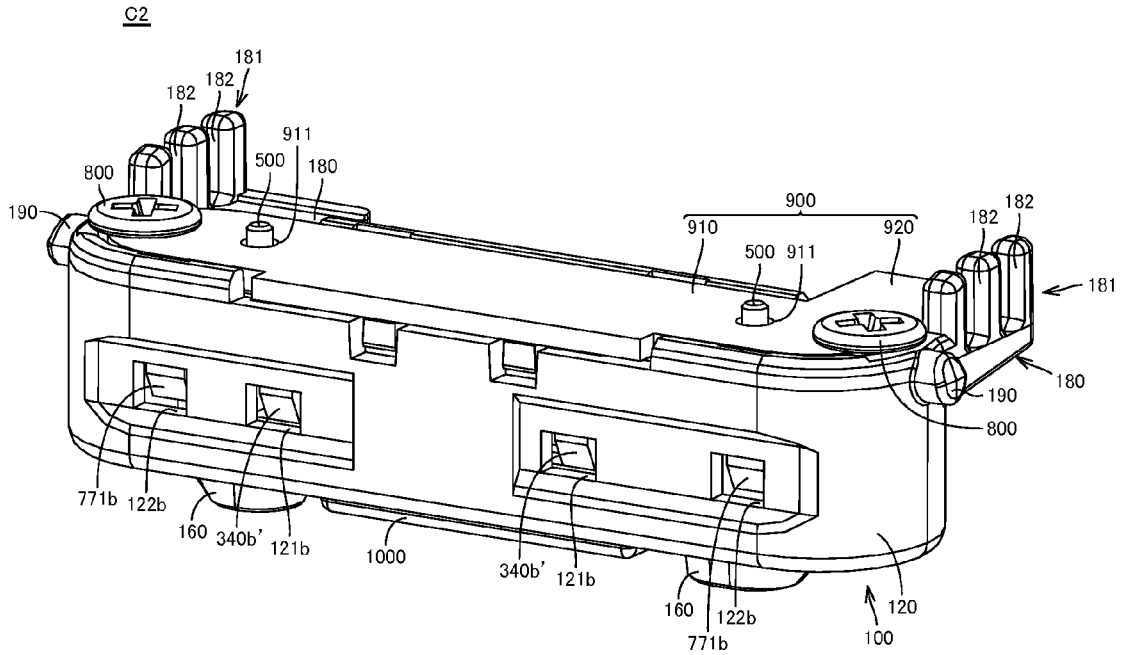
FIG. 5B is a rear bottom right perspective view of the connector.

Like the connector C1, the connector C2 is accommodated in the cabinet 10 of the electronic device illustrated in FIG. 4 such as to be exposed from the cabinet body 11 of the cabinet 10 and the opening 12*a* of the protective cover 12. When a mobile terminal is inserted into the protective cover 12, the distance between a magnetic body of the mobile terminal and the magnet 200 of the connector C2 becomes smaller than the distance from the magnet 200 to the shield member 600. This arrangement allows the magnet 200 of the connector C2 to be attracted to the magnetic body. During the insertion of the mobile terminal, the magnet 200, the cover 1000, and the holder 300' floatingly moves inside the accommodating recess 140 of the housing 100 in accordance with the orientation of the magnetic body. Also, the terminals of the mobile terminal are inserted into the guides 160 of the housing 100, and the plungers 530 of the terminals 500 are pressed onto terminals of the mobile terminal. The biasing parts 540 are compressed between the plungers 530 and the bottom of the tubes 511, and the plungers 530 are thereby brought into contact at a predetermined contact pressure with the terminals of the mobile terminal. This is how to connect the connector C2 to the mobile terminal.

The connector C2 and the electronic device have at least the following technical features in addition to the fourth to sixth technical features of the connector C1. First, it is possible to improve the bonding strength of the magnet 200 to the holder 300'. This is because the magnet 200 is bonded to the mounting walls 330*a*' and 330*b*' of the holder 300' and the area of the contact face 320' around the magnet 200. This arrangement can provide increased bonding area of the magnet 200 to the holder 300'. Hence the connector C2 is configured suitably for downsizing.

Second, the floatable unit can be easily assembled for the following reasons. The magnet 200 can be bonded to the holder 300' simply by inserting the magnet 200 into the accommodating portion 310' of the holder 300' so as to bring the magnet 200 into contact with the contact face 320' and by bonding the magnet 200 to the mounting walls 330*a*' and 330*b*' and the contact face 320' of the holder 300'.

Third, the holder 300', the cover 1000, and the magnet 200 are held in the housing 100 in a floatable manner with a simple structure. Specifically, the structure is such that the first engaging portions 340*a*' and 340*b*', which serve as the engaging projections of the holder 300', held in the second engaging portions 121*a* and 121*b*, which serve as the engaging holes of the housing 100, so as to allow the first engaging portions 340*a*' and 340*b*' to move in the Z-Z' direction.

Seventh, the magnet 200 is covered and protected by the cover 1000.

The connector and the electronic device of the invention are not limited to the above embodiments and may be modified in any manner within the scope of the claims. Specific modifications will be described below.

The holder of the invention may be any holder that holds at least one of a magnet and a yoke, is accommodated in a housing in a floatable manner, and has at least one mounting wall. When the holder holds the yoke, the magnet may be fixed to the yoke. In this case, the holder holds the magnet via the yoke.

The first engaging portions of the holder of the invention may be provided in at least first and second side faces and spaced from each other in a first direction in each of the at least the first and second side faces. Alternatively, the first engaging portions may be provided in a circular tuboid circumferential surface of the holder in spaced relation to each other in the circumferential direction of the circumferential surface. The first engaging portions may engage with second engaging portions provided in the housing such as to be movable in the second direction crossing the first direction or the circumferential direction. Specifically, the first engaging portions and the second engaging portion are respectively the engaging projections and the engaging holes, or the engaging holes and the engaging projections. The engaging projections may engage with the engaging holes such as to be movable in a second direction, and the second direction may cross the first direction or the circumferential direction. The engaging holes may be bottomed holes.

The holder may have at least one mounting wall that may be disposed around and in spaced relation to and bonded to a magnet, or disposed around and in spaced relation to and bonded to a yoke fixed to a magnet. For instance, the at least one mounting wall may be modified to a frame-shaped mounting wall disposed around and in spaced relation to and bonded to a magnet, or may be modified as a plurality of mounting walls disposed around and in spaced relation to and bonded to a magnet. In the case where a yoke is fixed to a magnet, the at least one mounting wall may be modified to a frame-shaped mounting wall disposed around and in spaced relation to and bonded to the yoke, or may be modified as a plurality of mounting walls disposed around and in spaced relation to and bonded to the yoke. Alternatively, the at least one mounting wall may be modified to a frame-shaped mounting wall disposed around and in spaced relation to and bonded to a magnet and a yoke, or may be modified as a plurality of mounting walls disposed around and in spaced relation to and bonded to a magnet and a yoke. The at least one mounting wall of the above embodiments and modifications may be disposed on a contact face of the yoke in contact with the magnet or on a contact face of the holder in contact with the magnet. The at least one mounting wall of the above embodiments and modifications may be generally of L-shaped and extending from the periphery the contact face of the yoke or of the holder so as be spaced from the contact face. The at least one mounting wall of the above embodiments and modifications may be disposed around the contact face. The at least one mounting wall of the above embodiments and modifications may have an inner face to face the magnet or the yoke, and the inner face may of any shape, such as a face having projections and depressions, a flat face, and a face of arc-shaped cross-section. The holder described in this paragraph can be any holder of any of the above aspects.

The yoke of the invention may be omitted. In addition, the yoke of the invention may be held in the holder such as to be in contact with the magnet, or may be fixed to the magnet. For instance, the yoke may be embedded in the holder by insert molding or other means such that the contact face of the yoke is exposed through the second accommodating portion of the holder to the outside of the holder. In this case, the first accommodating portion should be omitted. The yoke may be fixed to a face other than the lower face, the side faces, and the circumferential surface of the magnet. The holder described in this paragraph can be any holder of any of the above aspects.

The cover of the invention may be modified in any manner as long as it can cover at least a side face or a circumferential surface of the magnet. For instance, the cover may have a polygonal tuboid part for covering the side faces of the magnet, or a circular tuboid part for covering the circumferential surface of the magnet. The top plate and/or the flange of the cover of the invention may be omitted. The above-described polygonal tuboid part or the circular tuboid part may be provided with the top plate and/or the flange. A cover of the above embodiments and modifications may cover the magnet 200 of the first embodiment. A cover of the above modifications may cover the magnet 200 of the second embodiment. The cover of the invention can be made of a material other than a metal, such as plastic material.

The housing of the invention may be any housing adapted to floatably accommodate the holder to which at least the magnet is bonded. For instance, the housing may accommodate the holder and the magnet. In this case, the magnet may be partially exposed through the opening of the housing to the outside of the housing or may not be exposed from the housing. In other words, the opening of the housing may be omitted. The housing may have any accommodating recess adapted to floatably accommodate the holder to which at least the magnet is bonded. For instance, the accommodating recess of the housing may floatably accommodate the holder with a configuration that the accommodating recess is larger in Z-Z' direction dimension than the holder. In this case, the first engaging portion and the second engaging portion should be omitted. The accommodating recess may not communicate with the opening. In addition, the magnet and the mounting wall(s) of the holder may project or be exposed through the opening of the housing to the outside of the housing. In this case, the first engaging portions of the holder may preferably engage with the second engaging portions of the housing as described above.

The connector of the invention may have at least one terminal to be held by the housing of any of the above aspects and be contactable with a terminal of a connection object. The at least one terminal may be at least one of a charging terminal or a signal transmitting terminal. In addition, the terminal(s) of the invention may be made of a metal plate. The terminal(s) of any of the above aspects may be pressed and held in the accommodating hole of the housing, or may be insert-molded and held in the housing.

The closing member of the invention may be omitted. The closing member of the invention may any member fixed to the housing so as to close the accommodating recess of the housing of any of the above aspects.

The circuit board of the invention may be omitted. When the circuit board is omitted, the terminal(s) of any of the above aspects may be connected to a lead terminal or terminals, by means of which the terminal(s) may be connected to the outside of the connector, such as to an electronic device. The circuit board of the invention may any circuit board located on one or the other side of a thickness direction of the closing member and electrically connected to the terminal(s) of any of the above aspects. Also, an electronic component may be mounted on the circuit board of the invention. The electronic component may be mounted on the circuit board 900 so as to be disposed in the recess 730 of the closing member 700. In this case, the electronic component is covered and shielded by the shield member 600.

The shield member of the invention may be omitted. Alternatively, the shield member of the invention may be modified to any shield member disposed between the circuit board of any of the above aspects and the magnet of any of the above aspects.

The screws of the invention may be omitted. In the connector of the invention, other fixing means in place of the screws, such as pins and an adhesive, may be used to fix the closing member and/or the circuit board to the housing.

The electronic device of the invention may be any device including the connector of any of the above aspects and a cabinet accommodating the connector. The electronic device of the invention is not limited to charging devices for mobile terminals. The cabinet of the electronic device of the invention may have a case body only.

It should be appreciated that the connector and electronic device of the above embodiments are described above by way of examples only and may have any materials, shapes, dimensions, numbers, arrangements, and other configurations if they can perform similar functions. The configurations of the embodiment and the modifications described above may be combined in any possible manner. The X-X' direction may be modified in may be any direction crossing the Y-Y' direction. The Z-Z' direction may be may be any direction crossing the Y-Y' and X-X' directions. The neutral position may be defined in any manner.

REFERENCE SIGNS LIST

C1: Connector
100: Housing
110: Top
  111: Opening
120: Peripheral wall
  121*a*: Second engaging portion
  121*b*: Second engaging portion
  122*a*: Third engaging portion
  122*b*: Third engaging portion
130: Partition
140: Accommodating recess (accommodating recess of the housing)
150: Accommodating portion
  151: Accommodating hole
160: Guide
170: Fixing portion
  171: Screw hole
180: Leg
  181: tooth
  182: Slit
190: Shaft
200: Magnet
300: Holder
301 to 304: Side face
310: First accommodating portion
320: Second accommodating portion
330*a*: Mounting wall
  331*a*: Inner face
330*b*: Mounting wall
  331*b*: Inner face
340*a*: First engaging portion
340*b*: First engaging portion
350: Hole
400: Yoke
410: Contact face
500: Terminal
510: Barrel
  511: Tube
  512: Connecting portion
520: Flange
530: Plunger
540: Biasing part
550: Insulator
600: Shield member
610: Shield plate
620: Shoulder
700: Closing member
710: Base
720: Projection
  721: Opening
730: Recess
740: Receiving hole
750: Through-hole
760: Cut-out
770*a*: Engaging arm
  771*a*: Hook
770*b*: Engaging arm
  771*b*: Hook
800: Screw
900: Circuit board
910: Board body
  911: Through-hole electrode
  912: Cut-out

920: Connecting portion
C2: Connector
300': Holder
301' to 304': Side face
310': Accommodating portion
320': Contact face
330*a*': Mounting wall
331*a*': Inner face
330*b*': Mounting wall
331*b*': Inner face
340*a*': First engaging portion
340*b*': First engaging portion
350': Hole
1000: Cover
1100: Tube
1200: Top plate
1300: Flange
10: Cabinet
11: Cabinet body
12: Protective cover
12*a*: Opening (opening of the cabinet)

The invention claimed is:

1. A connector comprising:
a housing;
a magnet; and
a holder accommodated in the housing in a floatable manner and configured to hold the magnet, the holder including:
a recess accommodating the magnet; and
a mounting wall being a side wall of the recess, the mounting wall being disposed around and in spaced relation to the magnet and bonded to the magnet.

2. The connector according to claim 1, wherein the holder includes a contact face, the contact face being the bottom of the recess and in contact with the magnet,
the mounting wall is disposed on the contact face, in spaced relation to the contact face, or around the contact face,
the magnet is bonded to the mounting wall and the contact face.

3. The connector according to claim 1, wherein the mounting wall includes an inner face having projections and depressions, the projections and depressions of the inner face being bonded to the magnet.

4. The connector according to claim 1, wherein
the holder further includes a plurality of side faces and a plurality of first engaging portions,
the side faces include first and second side faces opposed to each other,
the first engaging portions are disposed in the first and second side faces and space from each other in a first direction in each of the first and second side faces,
the housing includes a plurality of second engaging portion at positions corresponding to the first engaging portions,
the first engaging portions are engaging projections and the second engaging portions are engaging holes, or alternatively the second engaging portions are engaging projections and the first engaging portions are engaging holes, and
the engaging projection engage with the engaging holes such as to be movable in a second direction, the second direction crossing the first direction.

5. The connector according to claim 1, wherein
the holder further includes:
a circumferential surface of circular tuboid shape, and
a plurality of first engaging portions in the circumferential surface in spaced relation to each other in a first direction, the first direction being the circumferential direction of the circumferential surface,
the housing includes a plurality of the second engaging portions at positions corresponding to the first engaging portions,
the first engaging portions are engaging projections and the second engaging portions are engaging holes, or alternatively the second engaging portions are engaging projections and the first engaging portions are engaging holes, and
the engaging projections engage with the engaging holes such as to be movable in a second direction, the second direction crossing the first direction.

6. The connector according to claim 1, wherein
the housing has an opening to allow the magnet to be partially exposed to the outside of the housing, and
the opening is of dimensions that are larger than the outer dimensions of the magnet and smaller than the outer dimensions of the holder.

7. The connector according to claim 6, further comprising a cover configured to cover at least a side face of the magnet or at least a peripheral surface of the magnet.

8. The connector according to claim 7, wherein
the cover includes:
a tuboid portion configured to cover the side face or the peripheral surface of the magnet, and
a flange on the tuboid portion, the flange being abuttable on an edge of the opening of the housing from inside of the housing.

9. The connector according to claim 6, wherein
the housing further includes:
an accommodating recess provided in the housing such as to communicate with the opening, and
a top of the accommodating recess, the opening of the housing is made in the top,
the holder and the magnet are accommodated in the accommodating recess in a floatable manner and such that the magnet is partially exposed from the opening, and
the connector further includes a closing member fixed to the housing so as to close the accommodating recess.

10. The connector according to claim 9, further comprising a terminal, wherein
the housing further includes an accommodating hole extending through the housing and accommodating the terminal at least partially, and
the terminal includes a flange held between the housing and the closing member.

11. The connector according to claim 9, further comprising:
a circuit board located on one or the other side of a thickness direction of the closing member; and
a shield member located between the circuit board and the magnet.

12. The connector according to claim 10, wherein the housing further includes a slit configured to accommodate a lead wire partially.

13. The connector according to claim 1, further comprising a terminal held by the housing.

14. The connector according to claim 13, wherein the terminal includes:

a barrel having electrical conductivity, a plunger movably accommodated in the barrel, a biasing part configured to bias the plunger in a direction in which the plunger projects from the barrel, and an insulator interposed between the biasing part and the plunger.

15. A connector comprising:

a housing;

a magnet;

a holder accommodated in the housing in a floatable manner and configured to hold the magnet, the holder including a mounting wall, the mounting wall being disposed around and in spaced relation to the magnet and bonded to the magnet; and a yoke being held by the holder and in contact with the magnet.

16. The connector according to claim 15, wherein the yoke includes a contact face in contact with the magnet, the mounting wall is disposed on the contact face, in spaced relation to the contact face, or around the contact face, the magnet is bonded to the mounting wall and the contact face.

17. A connector comprising:

a housing;

a magnet;

a yoke fixed to the magnet; and a holder accommodated in the housing in a flexible manner and configured to hold the yoke, the holder including:

a recess accommodating the magnet, and a mounting wall being a side wall of the recess, the mounting wall being disposed around and in spaced relation to the yoke and bonded to the yoke.

18. The connector according to claim 17, wherein the housing an opening to allow the magnet to be partially exposed to the outside of the housing, and the opening is of dimensions that are larger than the outer dimensions of the magnet and smaller than the outer dimensions of the holder.

19. The connector according to claim 18, further comprising a cover configured to cover at least a side face of the magnet or at least a peripheral surface of the magnet.

20. An electronic device comprising:

the connector according to claim 1; and a cabinet accommodating the connector.

* * * * *